US005522009A

United States Patent [19]

Laurent

[11] Patent Number: 5,522,009

[45] Date of Patent: May 28, 1996

[54] QUANTIZATION PROCESS FOR A PREDICTOR FILTER FOR VOCODER OF VERY LOW BIT RATE

[75] Inventor: Pierre-André Laurent, Bessancourt, France

[73] Assignee: Thomson-CSF, Puteaux, France

[21] Appl. No.: 957,376

[22] Filed: Oct. 7, 1992

[30] Foreign Application Priority Data

Oct. 15, 1991 [FR] France ..... 91 12669

[51] Int. Cl.[6] ..... G10L 3/02

[52] U.S. Cl. ..... 395/2.3; 395/2.31

[58] Field of Search ..... 381/30; 395/2.28, 395/2.3, 2.31, 2.38, 2.39, 2.47

[56] References Cited

U.S. PATENT DOCUMENTS

| | | | |
|---|---|---|---|
| 3,715,512 | 2/1973 | Kelly | 381/30 |
| 4,791,670 | 12/1988 | Copperi et al. | 395/2.31 |
| 4,811,396 | 3/1989 | Yatsuzuka | 381/30 |
| 4,815,134 | 3/1989 | Picone et al. | 395/2.31 |
| 4,852,179 | 7/1989 | Fette | 395/2 |
| 5,274,739 | 12/1993 | Woodard | 395/2.47 |

FOREIGN PATENT DOCUMENTS 428445 5/1991 European Pat. Off. .

OTHER PUBLICATIONS

Mori et al, "A Voice Activated Telephone", IEEE Int'l Conf on Consumer Electronics, Jun. 3–6, 1986, pp. 102–103.

Kemp et al, "Multi–Frame Coding of LPC Parameters at 600–800 BPS", Int'l Conf on Acoustics, Speech & Signal Proc, May 14–17, 1991, pp. 609–612 vol. 1.

Chandra, et al., IEEE Transactions on Acoustics, Speech, and Signal Processing, vol. ASSP 25, No. 4, Aug. 1977, pp. 322–330. "Linear Prediction with a Variable Analysis Frame Size".

Viswanathan, et al., IEEE Transactions on Communications, vol. Com–30, No. 4, Apr. 1982, pp. 674–686. "Variable Frame Rate Transmission: A Review of Methodology and Application to Narrow–Band LPC Speech Coding".

ICCE '86 (1986 IEEE International Conference on Consumer Electronics, Jun. 3–6, 1986), pp. 102, & 103, N. Mori, et al., "A Voice Activated Telephone".

(List continued on next page.)

*Primary Examiner*—Allen R. MacDonald
*Assistant Examiner*—Thomas J. Onka
*Attorney, Agent, or Firm*—Oblon, Spivak, McClelland, Maier & Neustadt

[57] ABSTRACT

A quantization process proposes a low data rate for predictor filters of a vocoder with a speech signal broken down into packets having a predetermined number L of frames of constant duration and a weight allocated to each frame according to the average strength of the speech signal in the respective frame. The process involves allocating a predictor filter for each frame and determining the possible configurations for predictor filters having the same number of coefficients and the possible configuration for which the coefficients of a current frame predictor filter are interpolated from the predictor filter coefficients from neighboring frames. Subsequently, a deterministic error is calculated by measuring the distances between the filters in order to form a first stack with a predetermined number of configurations which give the lowest errors. Subsequently, each predictor filter which is in the first stack configuration is assigned a specific weight for weighting a quantization error of each predictor filter as a function of the weight of the neighboring frames of predictor filters and stacking in a second stack, the configurations for which the sum of the deterministic error and the quantization error is minimal after weighting of quantization error by the specific weights. Lastly, the configuration for which a total error is a minimal value is selected from the second stack.

8 Claims, 3 Drawing Sheets

OTHER PUBLICATIONS

IEEE Transactions on Acoustics, Speech, and Signal Processing, vol. ASSP–24, No. 5, Oct. 1976, pp. 380–391, A. H. Gray, Jr. et al., "Distance Measures For Speech Processing".

ICASSP'89(1989 International Conference on Acoustics, Speech, and Signal Processing, May 23–26, 1989), vol. 1, pp. 156–159, T. Taniguchi, et al., "Multimode Coding: Application to CELP".

IEEE Global Telecommunications Conference & Exhibition, vol. 1, Nov. 28–Dec. 1, 1988, pp. 290–294, M. Young, et al., "Vector Excitation Coding With Dynamic Bit Allocation".

ICASSP'87(1987 International Conference on Acoustics, Speech, and Signal Processing, Apr. 6–9, 1987), vol. 3, pp. 1653–1656, J. Picone, et al., "Low Rate Speech Coding Using Contour Quantization".

Milcom '91 (1991 IEEE Military Communications in a Changing World, Nov. 4–7, 1991), vol. 3, pp. 1215–1219, Bruce Fette, et al., "A 600 BPS LPC Voice Coder".

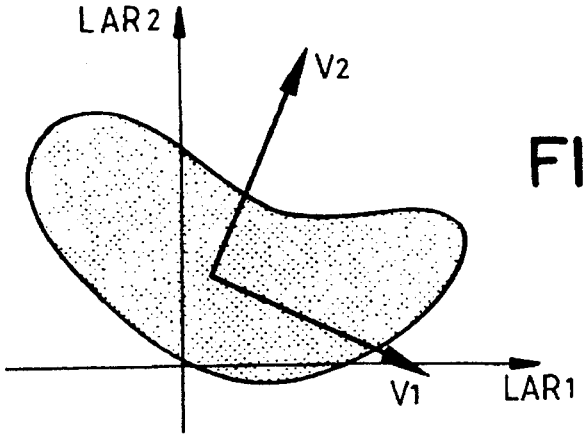
FIG. 2
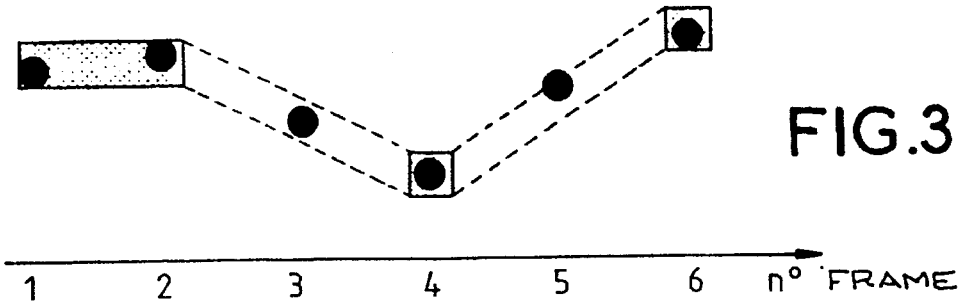
FIG.3
| N° | CONFIGURATION | N° | CONFIGURATION |
|---|---|---|---|
| 1: | 3,2,1 | 17: | 1,3,0,1 |
| 2: | 3,1,2 | 18: | 2,2,0,1 |
| 3: | 1,3,2 | 19: | 3,1,0,1 |
| 4: | 2,3,1 | 20: | 1,0,0,2,1 |
| 5: | 2,1,3 | 21: | 1,0,0,1,2 |
| 6: | 1,2,3 | 22: | 1,0,1,0,2 |
| 7: | 2,2,2 | 23: | 1,1,0,0,2 |
| 8: | 1,0,3,1 | 24: | 1,0,2,0,1 |
| 9: | 1,0,2,2 | 25: | 2,0,0,1,1 |
| 10: | 1,0,1,3 | 26: | 2,0,1,0,1 |
| 11: | 2,0,2,1 | 27: | 2,1,0,0,1 |
| 12: | 2,0,1,2 | 28: | 1,2,0,0,1 |
| 13: | 1,1,0,3 | 29: | 1,0,0,0,1,1 |
| 14: | 1,2,0,2 | 30: | 1,1,0,0,0,1 |
| 15: | 2,1,0,2 | 31: | 1,0,1,0,0,1 |
| 16: | 3,0,1,1 | 32: | 1,0,0,1,0,1 |
FIG.4

QUANTIZATION PROCESS FOR A PREDICTOR FILTER FOR VOCODER OF VERY LOW BIT RATE

BACKGROUND OF THE INVENTION

The present invention concerns a quantization process for a predictor filter for vocoders of very low bit rate.

It concerns more particularly linear prediction vocoders similar to those described for example in the Technical Review THOMSON-CSF, volume 14, no° 3, September 1982, pages 715 to 731, according to which the speech signal is identified at the output of a digital filter of which the input receives either a periodic waveform, corresponding to voiced sounds such as vowels, or a variable waveform corresponding to unvoiced sounds such as most consonants.

It is known that the auditory quality of linear prediction vocoders depends heavily on the precision with which their predictor filter is quantified and that this quality decreases when the data rate between vocoders deceases because the precision of filter quantization then becomes insufficient. Generally, the speech signal is segmented into independent frames of constant duration and the filter is renewed at each frame. Thus, to reach a rate of about 1820 bits per second, it is necessary, according to a normalized standard embodiment, to represent the filter by a 41-bit packet transmitted every 22.5 milliseconds. For non-standard links of lower bit rate of the order of 800 bits per second, less than 800 bits per second must be transmitted to represent the filter, in other words a data rate three times lower than in standard embodiments. Nevertheless, to obtain a satisfactory precision of the predictor filter, the classic approach is to implement the vectorial quantization method which is intrinsically more efficient than that used in standard systems where the 41 bits implemented enable scalar quantization of the P=10 coefficients of their predictor filters. The method is based on the use of a dictionary containing a known number of standard filters obtained by learning. The method consists ill transmitting only the page or the index containing the standard filter which is the nearest to the ideal one. The advantage appears in the reduction of the bit rate which is obtained, only 10 to 15 bits per filter being transmitted instead of the 41 bits necessary in scalar quantization mode. However, this reduction in output is obtained at the expense of a very large increase in the size of memory, needed to store the dictionary, and much more computation due to the complexity of the algorithm used to search for filters in the dictionary. Unfortunately, the dictionary which is created is never universal and in fact only allows the filters which are close to the learning base to be quantized correctly. Consequently, it seems that the dictionary cannot have both a reasonable size and allow satisfactory quantization of prediction filters, resulting from speech analysis for all speakers, for all languages and for all sound recording conditions.

Finally, where standard quantizations are vectorial, they aim above all to minimize the spectral distance between the original filter and the transmitted quantified filter and it is not guaranteed that this method is the best in view of the psycho-accoustic properties of the ear which cannot be considered to be simply those of a spectrum analyser.

SUMMARY OF THE INVENTION

The purpose of the present invention is to overcome these disadvantages.

In order to overcome these disadvantages, the quantization process proposes a low data rate for predictor filters of a vocoder with a speech signal broken down into packets having a predetermined number L of frames of constant duration and a weight allocated to each frame according to the average strength of the speech signal in the respective frame. The process involves allocating a predictor filter for each frame and determining the possible configurations for predictor filters having the same number of coefficients and the possible configuration for which the coefficients of a current frame predictor filter are interpolated from the predictor filter coefficients from neighboring frames. Subsequently, a deterministic error is calculated by measuring the distances between the filters in order to form a first stack with a predetermined number of configurations which give the lowest errors. Each predictor filter which is in the first stack configuration is then assigned a specific weight for weighting a quantization error of each predictor filter as a function of the weight of the neighboring frames of predictor filters and, stacking in a second stack, the configurations for which the sum of the deterministic error and the quantization error is minimal after weighting of quantization error by the specific weights. Lastly, the configuration for which a total error is a minimal value is selected from the second stack.

The main advantage of the process according to the invention is that it does not require prior learning to create a dictionary and that it is consequently indifferent to the type of speaker, the language used or the frequency response of the analog parts of the vocoder. Another advantage is that of achieving for a reasonable complexity of embodiment, an acceptable quality of reproduction of the speech signal, which only depends on the quality of the speech analysis algorithms used.

BRIEF DESCRIPTION OF THE DRAWINGS

Other characteristics and advantages will appear in the following description with reference to the drawings in the appendix which represent:

FIG. 2: a two-dimensional vectorial space showing the air coefficients derived from the reflection coefficients used to model the vocal conduct in vocoders.

FIG. 3: an example of grouping predictor filter coefficients as per a determined number of speech signal frames which allows the quantization process of the predictor filter coefficients of the vocoders to be simplified.

FIG. 4: a table showing the possible number of configurations obtained by grouping together filter coefficients for 1, 2 or 3 frames and the configurations for which the predictor filter coefficients for a standard frame are obtained by interpolation.

DESCRIPTION OF THE PREFERRED EMBODIMENT

Figure 1:
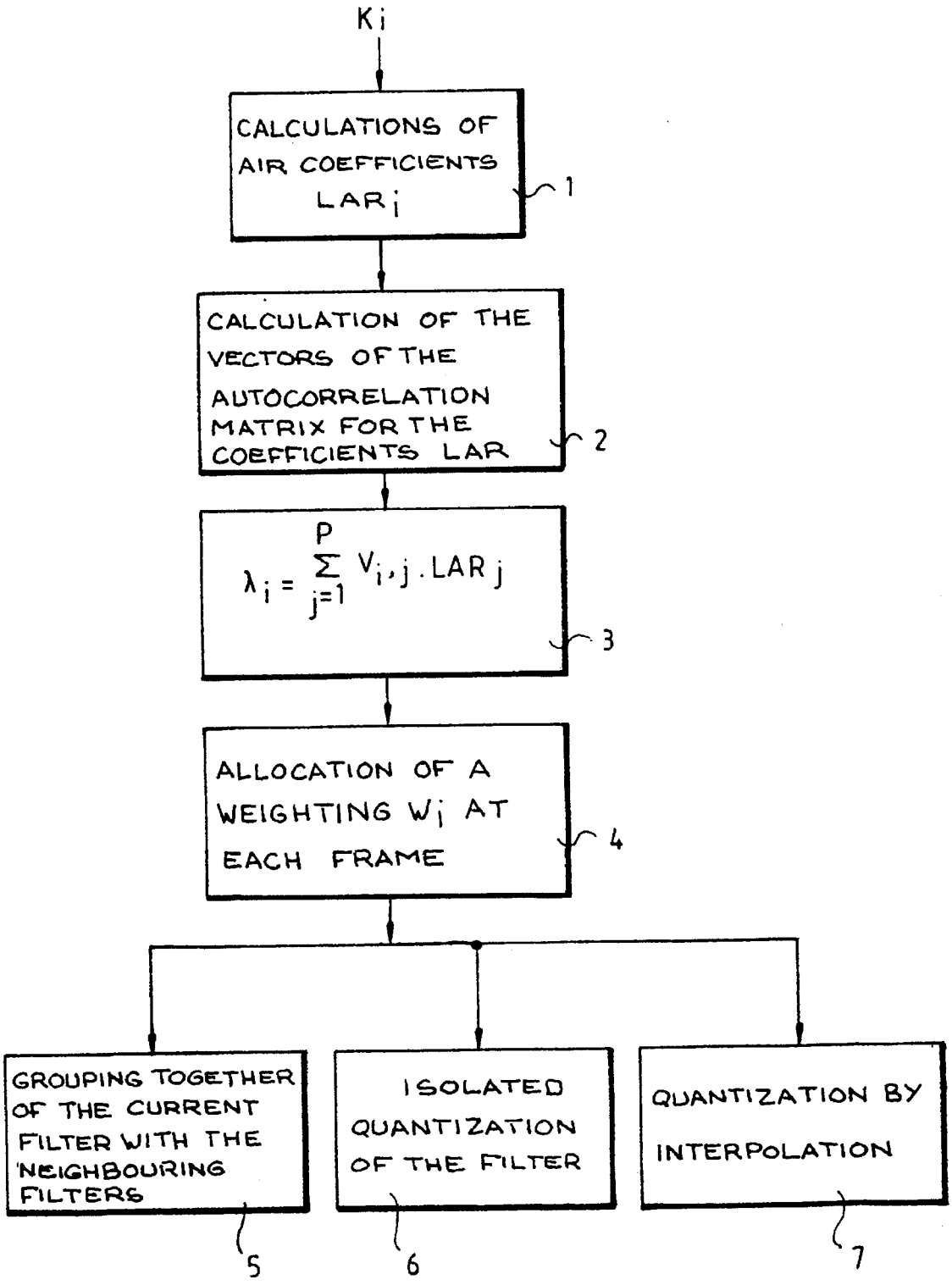
FIG. 1: the first stages of the process according to the invention in the form of an flowchart.

The process according to the invention which is represented by the flowchart of FIG. 1 is based on the principle that it is not useful to transmit the predictor filter coefficients too often and that it is better to adapt the transmission to what the ear can perceive. According to this principle, the replacement frequency of the filter coefficients is reduced, the coefficients being sent every 30 milliseconds for example instead of every 22.5 milliseconds as is usual in standard solutions. Furthermore, the process according to the invention takes into account the fact that the speech signal spectrum is generally correlated from one frame to the next by grouping together several frames before any coding is carried out. In cases where the speech signal is constant, i.e. its frequency spectrum changes little with time or in cases where frequency spectrum presents strong resonances, a fine quantization is carried out. On the other hand if the signal is unstable or not resonant, the quantization carried out is more frequent but less finely, because in this case the ear cannot perceive the difference. Finally, to represent the predictor filter the set of coefficients used contains a set of p coefficients which are easy to quantify by an efficient scalar quantization.

As in standard processes the predictor filter is represented in the form of a set of p coefficients obtained from an original sampled speech signal which is possibly pre-accentuated. These coefficients are the reflection coefficients denoted $K_i$ which model the vocal conduct as closely as possible. Their absolute value is chosen to be less than 1 so that the condition of stability of the predictor filter is always respected. When these coefficients have an absolute value close to 1 they are finely quantified to take into account the fact that the frequency response of the filter becomes very sensitive to the slightest error. As represented by stages 1 to 7 on the flowchart in FIG. 1, the process first of all consists of distorting the reflection coefficients in a non-linear manner, in stage 1, by transforming them into coefficients denoted as $LAR_i$ (as in "Log Area Ratio") by the relation:

$$LAR_i = \ln\left(\frac{1+K_i}{1-K_i}\right) \qquad i = 1 \ldots P \tag{1}$$

The advantage in using the LAR coefficients is that they are easier to handle than the $K_i$ coefficients as their value is always included between $-\infty$ and $+\infty$. Moreover in quantifying them in a linear manner the same results can be obtained as by using a non-linear quantization of the $K_i$ coefficients. Furthermore, the analysis into main components of the scatter of points having $LAR_i$ coefficients as coordinates in a P-dimensional space shows, as is represented in a simplified form in the two dimensional space of FIG. 2, preferred directions which are taken into account in the quantization to make it as effective as possible. Thus, if $V_1, V_2 \ldots V_p$ are vectors of the autocorrelation matrix of the LAR coefficients, an effective quantization is obtained by considering the projections of the sets of the LAR coefficients on the own vectors. According to this principle the quantization takes place in stages 2 and 3 on quantities $\lambda_i$, such that:

$$\lambda_i = \sum_{j=1}^{P} V_{i,j}\, LAR_j \qquad i = 1 \ldots P \tag{2}$$

For each of the $\lambda_i$ a uniform quantization is carried out between a minimal value $\lambda_i$ mini and a maximal value $\lambda_i$ imax with a number of bits $N_i$ which is calculated by the classic means according to the total number N of bits used to quantize the filter the percentages of inertia corresponding to the vectors $V_i$.

To benefit from the non independence of the frequency spectrums from one frame to the next, a predetermined number of frames are grouped together before quantization. In addition, to improve the quantization of the filter in the frames which are most perceived by the ear, in stage 4 each frame is assigned of a weight $W_t$ (t lying between 1 and L) which is an increasing function of the accoustic power of each frame t considered. The weighting rule takes into account the sound level of the frame concerned (since the higher the sound level of a frame, in relation to neighbouring frames, the more this attracts attention) and also the resonant or non-resonant state of the filters, only the resonant filters being appropriately quantized.

A good measure of the weight $W_t$ of each frame is obtained by applying the relationship:

$$W_t = F\left(\frac{P_t}{\prod_{i=1}^{P}(1-K_{t,i}^2)}\right) \tag{3}$$

In equation (3), $P_t$ designates the average strength of tile speech signal in each frame of index t and $K_{t,i}$ designates tile reflection coefficients of the corresponding predictor filter. The denominator of the expression in brackets represents the reciprocal of the predictor filter gain, the gain being higher when the filter is resonant. The F function is an increasing monotone function incorporating a regulating mechanism to avoid certain frames having too low or high a weight in relation to their neighbouring frames. So, for example, a rule for determining the weights $W_t$ can be to adopt for the frame of index t that the quantity F is greater than twice the weight $W_{t-1}$ of the frame t–1. On the other hand, if for the frame of index t the quantity F is less than half the value $W_{t-1}$ of the frame t–1, the weight $W_t$ can be taken to be equal to half of the weight $W_{t-1}$. Finally, in other cases the weight $W_t$ can be set equal to F.

Taking into account the fact that the direct quantization of the L filters of a packet of standard frames cannot be envisaged because this would lead to the quantization of each filter with a number of bits insufficient to obtain an acceptable quality, and because the predictor filters of neighbouring frames are not independent, it is considered in stages 5, 6 and 7 that for a given filter three cases could occur depending on, first, whether the signal in the frame has high audibility and whether the current filter can be grouped together with one or several of its neighbouring frames, secondly, whether the whole set can be quantized all at once or, thrdly, whether the current filter can be approximated by interpolation between neighbouring filters.

These rules lead for example, for a number of filters L=6 of a block of frames, to only quantize the three filters if it is possible to group together three filters before quantization, which leads us to consider two possible types of quantization. An example grouping is represented in FIG. 3. For the six frames represented we see that frames 1 and 2 are grouped and quantized together, that the filters of frames 4 and 6 are quantized individually and that the filters of frames 3 and 5 are obtained by interpolation. In this drawing, the shaded rectangles represent the quantized filters, the circles represent the true filters and the hatched lines the interpolations. The number of possible configurations is represented by the table of FIG. 4. In this table, numbers 1, 2 or 3 placed in the configuration column indicate the respective groupings of 1, 2 or 3 successive filters and the number 0 indicates that the current filter is obtained by interpolation.

This distribution enables optimization of the number of necessary bits to apply to each effectively quantized filter. For example, in the case where only n=84 filter quantization bits are available in a packet of six frames, corresponding to 14 bits on average per frame, and if $n_1$, $n_2$ and $n_3$ designate the numbers of bits allocated to the three quantized filters, these numbers can be chosen among the values 24, 28, 32 and 36 so that their sum is equal to 84. This gives 10 possibilities in all. The way to choose the numbers $n_1$, $n_2$ and $n_3$ is thus considered as a quantization sub-choice, going back to the example of FIG. 3 as above. Applying the the preceding rules leads us, for example, to group together and quantize filters 1 and 2 together on $n_1$=28 bits, to quantize filters 4 and 6 individually on $n_2$=32 and $n_3$=24 bits respectively and to obtain filter 3 and 5 by interpolation.

In order to obtain the best quantization for all six filters knowing that there are 32 basic possibilities each offering 10 sub-choices corresponding to 320 possibilities without exploring exhaustively each of the possibilities offered, the choice is made by applying known methods of calculating distance between filters and by calculating for each filter the quantization error and the interpolation error. Knowing that the coefficients $\lambda_i$ are quantized simply, the distance between filters can be measured according to the invention by the calculation of a weighted euclidian distance of the form:

$$D(F_1, F_2) = \sum_{i=)1}^{P} \gamma i(\lambda_{1,i} - \lambda_{2,i})^2 \tag{4}$$

where the coefficients $\gamma_i$ are simple functions of percentages of inertias associated with the vectors $V_i$ and $F_1$ and $F_2$ are the two filters whose distance is measured. Thus to replace the filters of frames $T_{t+1} \ldots T_{t+k-1}$ by a single filter all that is needed is to minimize the total error by using a filter whose coefficients are given by the relationship:

$$\lambda_j = \frac{\sum_{i=0}^{k-1} W_{t+i}\,\lambda_{t+i,j}}{\sum_{i=0}^{k-1} W_{t+i}}, \quad j = 1 \ldots P \tag{5}$$

where $\lambda_{t+i,j}$ represents the $j_{th}$ coefficient of the predictor filter of the frame t+i. The weight to be allocated to the filter is thus simply the sum of the weights of the original filters that it approximates. The quantization error is thus obtained by applying the relationship:

$$E(N_j) = \frac{1}{12} \sum_{i=1}^{P} \gamma_i \left( \frac{\lambda_{imax} - \lambda_{imin}}{2^{n_{j,i}}} \right)^2 \quad \text{with} \sum_{i=1}^{P} n_{j,i} = N_j \tag{6}$$

As there is only a finite number of values of $N_j$, quantities $E_{Nj}$ are preferably calculated once and for all which allows them to be stored for example in a read-only memory. In this way the contribution of a given filter of rank t to the total quantization error is obtained by taking into account three coefficients which are: the weight $W_t$ which acts as a multiplying factor, the deterministic error possibly committed by replacing it by an average filter shared with one or several of its neighbours, and the theoretical quantization error $E_{Ng}$ calculated earlier depending on the number of quantization bits used. Thus if F is the filter which replaces filter $F_t$ of the frame t, the contribution of the filter of the frame t to the total quantization error can be expressed by a relation of the form:

$$E_t = W_t\{E(N_j) + D(F, F_t)\} \tag{7}$$

The coefficients $\lambda_i$ of the filters interpolated between filters $F_1$ and $F_2$ are obtained by carrying out the weighted sum of the coefficients of the same rank of the filters $F_1$ and $F_2$ according to a relationship of the form:

$$\lambda_i = \alpha\lambda_{1,i} + (1+\alpha)\lambda_{2,i} \text{ for } i=1 \tag{8}$$

As a result, the quantization error associated with these filters is, omitting the associated weights $W_t$, the sum of the interpolation error, i.e. the distance between each interpolated filter and the filter of frame T, $D(F_1, F_t)$ and of the weighted sum of the quantization errors of the 2 filters $F_1$ and $F_2$ used for the interpolation, namely:

$$\alpha^2 E(N_1) + (1-\alpha)^2 E(N_2) \tag{9}$$

if the two filters are quantized with $N_1$ and $N_2$ bits respectively.

This method of calculating allows the overall quantization error to be obtained using single quantized filters by calculating for each quantized filter K the sum of the quantization error due to the use of $N_K$ bits weighted by the weight of filter K (this weight may be the sum of weights of the filters of which it is the average if this is the case), of the quantization error induced on one or more of the filters which it uses to interpolate, weighted by a function of one or more of the coefficients—and one or more weights of one or more filters in question and of the deterministic error deliberately made by replacing certain filters by their weighted average and interpolating others.

As an example, by returning to the grouping on FIG. 3, a corresponding possibility of quantization can be obtained by quantizing:

filters $F_1$ and $F_2$ grouped on $N_1$ bits by considering all average filter F defined symbolically by the relation:

$$F = (W_1F_1 + W_2F_2)/(W_1 + W_2) \tag{10}$$

the filter $F_4$ on $N_2$ bits,
the filter $F_6$ on $N_3$ bits,
and filters $F_3$ and $F_5$ by interpolation.

The deterministic error which is independent of the quantizations is then the sum of the terms:

$W_1$ $D(F,F_1)$: weighted distance between F and $F_1$,
$W_2$ $D(F,F_2)$: weighted distance between F and $F_2$,
$W_3$ $D(F_3, (½ F+½ F_4))$ for filter 3 (interpolated),
$W_5$ $D(F_5, (½ F+½ F_6))$ for filter 4 (interpolated),
0 for filter 4 (quantized directly),
0 for filter 6 (quantized directly), The quantization error is the sum of the terms:

$(W_1+W_2)$ $E(N_1)$ for the average composite filter F
$W_4$ $E(N_2)$ for the filter 4, quantized as on $N_2$ bits
$W_6$ $E(N_3)$ for the filter 6, quantized as on $N_3$ bits
$W_3$ (¼ $E(N_1)$+¼ $E(N_2)$ for the filter 3, obtained by interpolation
$W_5$ (¼ $E(N_1)$+¼ $E(N_3)$ for filter 5, obtained by interpolation, or the sum of terms:

$E(N_1)$ weighted by a weight $w_1 = W_1 + W_2 + ¼W_3$
$E(N_2)$ weighted by $w_2$=¼ $W_3$+$W_4$+¼ $W_5$
$E(N_3)$ weighted by $w_3$=¼ $W_5$+$W_6$.

Figure 5:
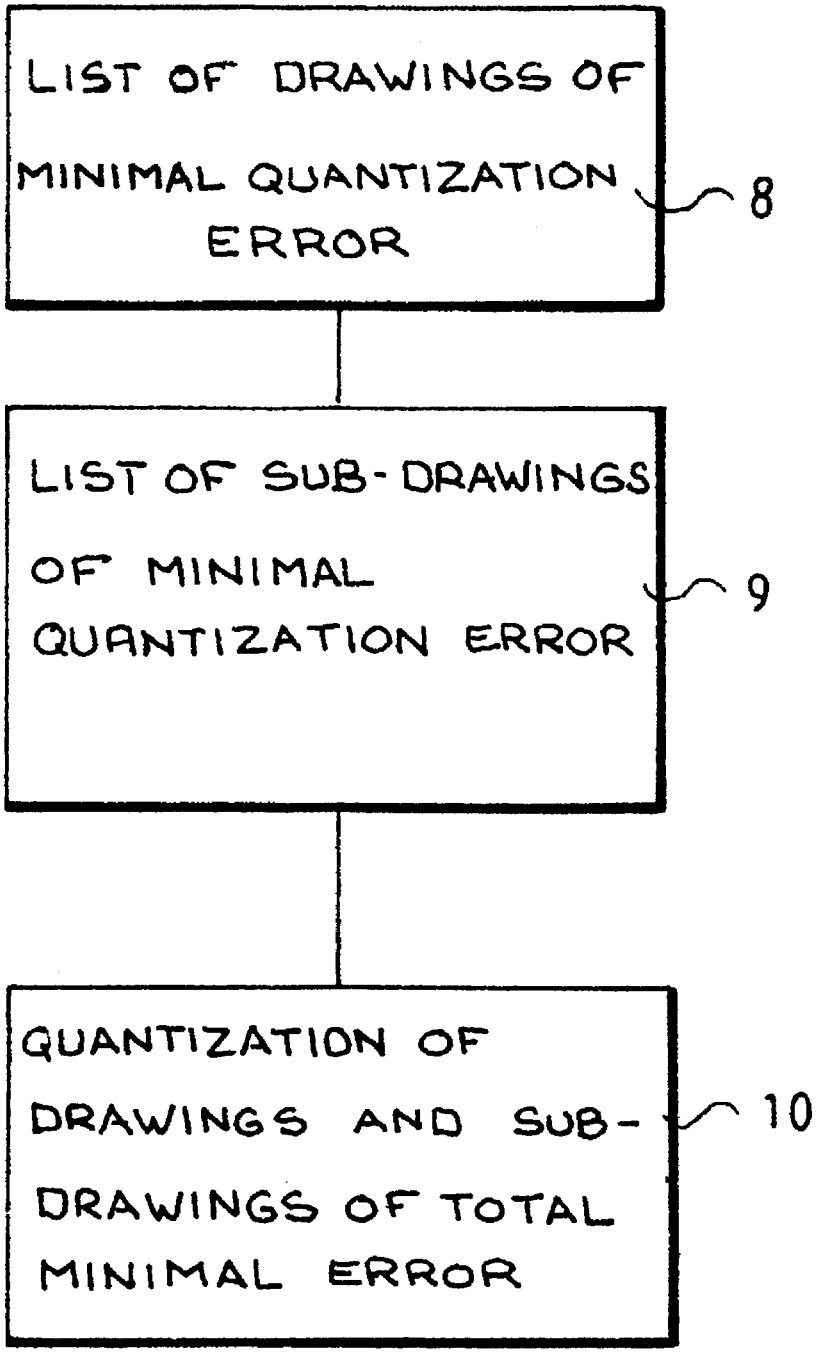
FIG. 5: the last stages of the process according to the invention in the form of an flowchart.

The complete quantization algorithm which is represented ill FIG. 5 includes three passes conceived in such a way that at each pass only the most likely quantization choices are retained.

The first pass represented in 8 on FIG. 5 is carried out continuously while the speech frames arrive. In each frame it involves carrying out all the feasible deterministic error calculations in the frame t and modifying as a result the total error to be assigned to all the quantization choices concerned. For example, for frame 3 of FIG. 3 the two average filters will be calculated by grouping frames 1, 2 and 3 or 2 and 3 which finish in frame 3, as well as the corresponding errors; then the interpolation error is calculated for all the quantization choices where frame 2 is calculated by interpolation using frames 1 and 3.

At the end of frame L all the deterministic errors obtained are assigned to the different quantization choices.

A stack can then be created which only contains the quantization choices giving the lowest errors and which alone are likely to give good results. Typically, about one third of the original quantization choices can be retained.

The second pass which is represented in 9 on FIG. 5 aims to make the quantization sub-choices (distribution of the number of bits allocated to the different filters to quantize) which give the best results for the quantization choices made. This selection is made by the calculation of specific weights for only the filters which are to be quantized (possibly composite filters), taking into account neighbouring filters obtained by interpolation. Once these fictitious weights are calculated, a second smaller stack is created which only contains the pairs (quantization choices+ sub-choices), for which the sum of the deterministic error and the quantization error (weighted by the fictitious weights) is minimal.

Finally, the last phase which is represented in 10 in FIG. 5 consists in carrying out the complete quantization according the choices (+ sub-choices) finally selected in the second stack and, of course, retaining the one which will minimize the total error.

In order to obtain the best quantization possible, it is still possible to envisage (if sufficient data processing power is available) the use of a more elaborate distance measurement, namely that known by Itakura-Saito which is a measurement of total spectral distortion, otherwise known as the prediction error. In this case, if $R_{t0}, R_{t1}, \ldots, R_{tp}$ are the first P+1 autocorrelation coefficients of the signal in a frame t, these are given by:

$$R_{t,k} = \frac{1}{N} \sum_{n=n_o}^{n=n_o+N-1} S_n S_{n-k} \tag{11}$$

where N is the duration of analysis used in frame t and $n_o$ the first analysis position of the signal S sampled. The predictor filter is thus entirely described by a transform into z such, $P(_z)$, such as:

$$P(z) = \frac{1}{\sum_{i=0}^{P} a_i z^{-1}} \quad \text{with } a_0 = 1 \tag{12}$$

in which the coefficients $a_j$ are calculated iteratively from the reflection coefficients $K_j$ deduced from the LAR coefficients which are themselves deduced from the coefficients by inverting the relationships (1) and (2) described above.

To initialize the calculations:

$$R_{t,k} = \frac{1}{N} \sum_{n=n_o}^{n=n_o+N-1} S_n S_{n-k} \tag{11}$$

and at the iteration p(p=1. . . P), the coefficients $a_j$ are defined by:

$$P(z) = \frac{1}{\sum_{i=0}^{P} a_i z^{-1}} \quad \text{with } a_0 = 1 \tag{12}$$

The prediction error thus verifies the relationship:

$$E_t = R_{t,0} \tilde{B}_{t,0} + 2 \sum_{i=1}^{P} R_{t,i} \tilde{B}_{t,i} \qquad 13$$

where B . . . (equation 14)

$$\text{with } \tilde{B}_{t,i} = \sum_{j=0}^{P-i} \tilde{a}_j \tilde{a}_{j+1}$$

In equation 13 and 14, the sign "~" means that the values are obtained using the quantized coefficients. By definition this error is minimal if there is no quantization because $K_j$ are precisely calculated such that this is the case.

The advantage of this approach is that the quantization algorithm obtained does not require enormous calculating power since, after all, after all, returning to example on FIG. 3 regarding the 320 coding possibilities, only four or five possibilities are selected and examined in detail. This allows powerful analysis algorithms to be used which is essential for a vocoder.

What is claimed is:

1. A quantization process for predictor filters of a vocoder having a very low data rate wherein a speech signal is broken down into packets having a predetermined number L of frames of constant duration and a weight allocated to each frame according to the average strength of the speech signal in the respective each frame, said process comprising the steps of:

allocating a predictor filter for each frame;

determining the possible configurations for predictor filters having the same number of coefficients and the possible configurations for which the coefficients of a current frame predictor filter are interpolated from the predictor filter coefficients of neighbouring frames;

calculating a deterministic error by measuring the distances between said filters for stacking, in a first stack, a predetermined number of configurations giving the lowest errors;

assigning to each predictor filter to be quantized, in said first stack configuration, a specific weight for weighting a quantization error of each predictor filter as a function of the weight of the neighbouring frames of predictor filters;

stacking, in a second stack, the configurations for which, after weighting of quantization error by said specific weights, the sum of the deterministic error and of the quantization error is minimal; and selecting, in the second stack, the configuration for which a total error is minimal.

2. A process according to claim 1 wherein, for each frame, the corresponding coefficients of the predictor filter are determined by taking those already determined in neighboring frame's if the frame's weight is approximately equal to at least one of said neighboring frames.

3. A process according to claim 2 wherein, for each frame, the corresponding coefficients of the predictor filter are determined by calculating the weight individually and by interpolating between the coefficients of neighboring frames.

4. Process according to claim 1 wherein in each packet of frames the predictor filter is quantized with different numbers of bits according to the groupings between frames carried out to calculate the filter coefficients, keeping constant the sum of the number of quantization bits available in each packet.

5. Process according to claim 4 wherein the number of quantization bits of the predictor filter in each frame is determined by carrying out a measurement of distance between filters in order to quantize only the filter with coefficients giving a minimal total quantization error.

6. Process according to claim 5 wherein the measurement of distance is euclidian.

7. Process according to claim 5 wherein the measurement of distance is that of ITAKURA-SAITO.

8. Process according to claim 4 wherein in each frame a predetermined number of quantization sub-choices with the smallest errors are selected, to calculate in each selected sub-choice a specific frame weight taking into account the neighbouring filters in order to use only the sub-choice whose quantization error weighted by the specific frame weight is minimum.

* * * * *